US012234824B2

(12) United States Patent
Goetz et al.

(10) Patent No.: US 12,234,824 B2
(45) Date of Patent: Feb. 25, 2025

(54) ECCENTRIC SCREW PUMP WITH A MODULAR DESIGN WITH A COMPRESSIBLE STATOR LINING TO ADJUST FOR WEAR AND/OR IMPROVE SEALING

(71) Applicant: NETZSCH Pumpen & Systeme GmbH, Selb (DE)

(72) Inventors: Frank Goetz, Polling (DE); Martin Zierhofer, Aschau am Inn (DE); Philipp Nuebl, Gras Bahnhof (DE); Stefan Voit, Amerang (DE)

(73) Assignee: NETZSCH Pumpen &Systeme GmbH, Selb (DE)

( * ) Notice: Subject to any disclaimer, the term of this patent is extended or adjusted under 35 U.S.C. 154(b) by 0 days.

(21) Appl. No.: 18/000,760

(22) PCT Filed: Jun. 1, 2021

(86) PCT No.: PCT/DE2021/000103
§ 371 (c)(1),
(2) Date: Dec. 5, 2022

(87) PCT Pub. No.: WO2021/244688
PCT Pub. Date: Dec. 9, 2021

(65) Prior Publication Data

US 2023/0265847 A1 Aug. 24, 2023

(30) Foreign Application Priority Data

Jun. 5, 2020 (DE) ..... 10 2020 114 937.9

(51) Int. Cl.
*F04C 2/107* (2006.01)

(52) U.S. Cl.
CPC ..... *F04C 2/1075* (2013.01); *F04C 2/1073* (2013.01); *F04C 2240/10* (2013.01); *F04C 2240/802* (2013.01)

(58) Field of Classification Search
CPC .. F04C 2/1075; F04C 2/1073; F04C 2240/10; F04C 2240/802
See application file for complete search history.

(56) References Cited

U.S. PATENT DOCUMENTS 4,313,717 A * 2/1982 Kopecky ..... F04C 2/1075 418/153
9,719,506 B2 * 8/2017 Kamal ..... F04C 2/1075
(Continued)

FOREIGN PATENT DOCUMENTS

DE 2313261 A1 9/1974
DE 19801021 A1 7/1999
(Continued)

OTHER PUBLICATIONS

International Search Report and Written Opinion of the International Searching Authority; Application No. PCT/DE2021/000103; Completed: Sep. 16, 2021; Mailing Date: Sep. 28, 2021; 11 Pages.
(Continued)

*Primary Examiner* — Mary A Davis
(74) *Attorney, Agent, or Firm* — Whitmyer IP Group LLC

(57) ABSTRACT

An eccentric screw pump with a rotor, which forms a conveyor screw, and a stator, which forms a screw thread and in which the rotor circulates during a conveying operation. The stator includes a single-part or multipart stator housing, in which a stator lining made of an elastomer material is located, said lining forming the screw thread. The stator lining forms a projection at least on one side in the direction along the pump longitudinal axis, said projection protruding from the stator housing such that a free force introduction surface is formed. A force can be applied via the
(Continued)

free force introduction surface, said force compressing the stator lining into the stator housing so that the stator lining is transversely elongated in the stator housing, leading to a constriction of the screw thread. The projection can be surrounded by a mobile support tube which is moved relative to the stator housing in the direction along the longitudinal axis of the stator housing for compression purposes.

10 Claims, 4 Drawing Sheets

(56) References Cited

U.S. PATENT DOCUMENTS

| | | | | |
|---|---|---|---|---|
| 2009/0288818 | A1 | 11/2009 | Brown et al. | |
| 2024/0125321 | A1* | 4/2024 | Suhara | F04C 2/1075 |

FOREIGN PATENT DOCUMENTS

| | | | | |
|---|---|---|---|---|
| DE | 19950257 | A1 * | 4/2001 | F04C 2/1075 |
| DE | 202007013820 | U1 | 12/2008 | |
| DE | 102008021920 | A1 | 2/2009 | |
| DE | 102016117910 | A1 | 3/2018 | |
| DE | 102017107962 | B3 | 9/2018 | |
| FR | 1284388 | A | 2/1962 | |
| FR | 2633673 | A1 * | 7/1988 | F04C 2/1073 |

OTHER PUBLICATIONS

German Search Report; Application No. 102020114937.9; Completed May 3, 2021; 3 Pages.

International Search Report and Written Opinion of the International Searching Authority; Application No. PCT/DE2021/000103; Completed: Dec. 6, 2022; 7 Pages.

* cited by examiner

– Prior Art –

ECCENTRIC SCREW PUMP WITH A MODULAR DESIGN WITH A COMPRESSIBLE STATOR LINING TO ADJUST FOR WEAR AND/OR IMPROVE SEALING

TECHNICAL FIELD

The invention relates to an eccentric screw pump comprising a stator, which can be adjusted predominantly as part of the regular operation, according to the claims. It further relates to a method for operationally adjusting the stator of such an eccentric screw pump.

BACKGROUND

Eccentric screw pumps have a variety of fields of application.

They are not least a preferred means of choice wherever highly viscous fluids with a consistency, which is difficult to handle, and/or with solids contents need to be pumped. This is why eccentric screw pumps are used in particular also when exploiting natural resources.

Eccentric screw pumps are thereby ideally suited for pumping fluids, which contain abrasive components. They benefit from the fact that the pumping effect of the eccentric screw pump is based on the principle of travelling conveying chambers, which form between the central conveyor screw and the screw flight with double lead formed by the stator lining.

There is nonetheless a need for being able to compensate wear, which may have occurred on the stator lining after some time, as part of the regular operation. Such a subsequent (re-)constricting of the screw flight formed by the stator lining is to be possible without requiring a dismantling of the eccentric screw pump or the installation and removal, respectively, of a stator lining for this purpose. The screw flight is to thus be capable of being set without dismantling or disassembly, respectively. Were this not so, each setting of the screw flight would result in a non-availability of the pump, which would lie outside of the usual maintenance times.

It can furthermore also be expedient to be able to set the screw flight for other reasons, for instance for the purpose of increasing the pre-tension, with which the screw flight formed by the stator lining rests against the conveyor screw. This can be necessary in order to ensure a better sealing in reaction to a certain viscosity of the fluid, which is to be pumped.

Such a settability can be reached in that one refrains from connecting the elastomeric stator lining to the external housing. If a compressive force or compression force, respectively, is now applied to the elastomeric, but incompressible, i.e. essentially volume-constant, stator lining in the direction of the screw pump longitudinal axis and if its transverse elongation in the radially outward direction is prevented at the same time, a significant transverse elongation of the stator lining occurs in the radially inward direction. The elastomeric stator lining thus "grows" radially to the inside. As a result, the screw flight formed by it becomes narrower.

In the case of a transverse elongation of this type of the stator lining, the interaction with the rotor screw guided in the stator contour, i.e. the screw flight, has the result that a larger overlap between the eccentric screw and the stator lining occurs as the screw flight becomes increasingly narrower. The increasing overlap can be used to either increase the sealing of the conveying chamber or to compensate wear-related material removal.

To be able to apply a compression force in this way and to have a long distance available, along which compression can take place, if necessary, it has already been considered to make use of the construction, which is shown schematically by FIG. 1.

An essential component part of this construction are the mobile and the stationary support tube 6, 7. Utilizing a compression device, which is not shown in FIG. 1, a compressive force D, which is directed towards the stator interior along the longitudinal axis L, is applied to the front annular surface S of the stator lining 5 by means of the support tubes 6, 7. Analogously, the application of a tractive force in the opposite direction can also be utilized.

The support tubes 6 and 7 prevent that the stator lining 5 gives way radially to the outside during its compression in the region of its projection 19. The stationary support tube 7 is thereby often equipped with an inner cone 10, into which the mobile support tube 6 inserts itself deeper with increasing compression. Under normal circumstances, the stationary support tube is elongated thereby, for the purpose of which significant forces are necessary, which would be more useful if they were available for generating a transverse elongation of the stator lining along the entire length.

SUMMARY

It is therefore the object of the invention to create a settable eccentric screw pump, in the case of which a more efficient displacement of the stator lining in the radially inward direction results over the length as part of its setting.

Solution According to the Invention

According to the invention, this object is solved by means of the means described in the claims.

The starting point is thus an eccentric screw pump comprising a rotor forming a conveyor screw, and a stator, which forms a screw flight and in which the rotor circulates during the conveying operation.

The stator comprises a single-part or multi-part stator housing—which, in the latter case, is optionally not only segmented or divided into several parts, respectively, transversely, but also in the direction of the stator longitudinal axis L. A stator lining made of an elastomeric, preferably vulcanized material, is located in said stator housing. With its central cavity, the stator lining forms the screw flight.

The stator lining forms a projection at least on one side along the pump longitudinal axis. Said projection projects from the stator housing so that a free force introduction surface is formed, via which a force can be applied, which compresses the stator lining all the way into the stator housing. The compression takes place so that a transverse elongation of the stator lining is created (especially also) in the stator housing. The transverse elongation creates a constriction of the screw flight.

With all this, the projection is encompassed on its outer circumference by a mobile support tube. As part of the compression, the mobile support tube can be displaced in the direction along the longitudinal axis of the stator housing relative to the stator housing.

According to the invention, the mobile support tube or its circumferential jacket surface, respectively, is arranged at least predominantly, preferably completely, in a recess of the stator lining, viewed in the radial direction. Ideally, only its radially projecting collar projects outwards. In the case of the preferred, complete arrangement in the recess, the outer circumferential surface of the mobile support tube ends in a flat or smooth manner, respectively. A diameter change compared to the surrounding outer circumferential surface of the stator lining is then—at least essentially—not present.

The necessity of having to widen the stationary support tube as part of the insertion of the mobile support tube and of having to apply corresponding forces for this purpose is thus eliminated.

It is ensured more efficiently in this way that the elongation restriction, which the stator lining experiences as part of its compression, leads to a "growing" of the stator lining in the radially inward direction.

According to the invention, an eccentric screw pump is thus obtained, which can be set more accurately or more evenly, respectively over its entire stator length.

At the same time, the eccentric screw pump according to the invention for the most part offers a particularly long distance, by which the stator lining can be compressed, so that an enlarged setting region results. If desired, the mobile support tube is preferably embodied so that it has an insertion length of at least ¼, or rather of at least ½, of the outer radius of the stator lining, which can be used for the compression.

Optional Refinements

As long as the compression of the stator lining is accomplished solely in that pressure is applied to the free front annular surface, which is available on the front side of the stator lining at the free end of the projection, the risk of unwanted non-uniformities exists during the setting. If the necessary pressure becomes too high, the front side of the stator lining deforms very strongly in the immediate vicinity of the force introduction. A portion of the compression effect, which is actually required within the stator housing, thus "fizzles out".

In view of this, it turned out to be particularly advantageous when the mobile support tube is connected by means of a substance-to-substance bond to the stator lining at least on its inner jacket surface. This connection is embodied so that the respective compression force can be transferred solely or at least predominantly to the stator lining via said connection by generating shear stresses. Protection is also claimed for this alone.

The connection by means of a substance-to-substance bond can in particular be an "adhesive connection by means of vulcanization", otherwise also a bonding in the actual sense or a welding, for instance with a plastic layer of the support tube. The support tube can have connection aids, for instance holes/openings, into which material penetrates, which is later solidified by means of the vulcanizing, ribs or a particularly rough, for instance knurled inner surface, which interlocks with, tightly connects to, the vulcanized material in this way.

Due to this specific way, the stator lining can be compressed particularly well or uniformly, respectively, as part of the setting, even when an extremely strong compression is required.

It can be expedient to design the eccentric screw pump so that the mobile support tube can be inserted into the stator housing itself for compression purposes, and that its outer diameter is smaller than the smallest inner diameter of the section of the stator housing, which is available for insertion purposes. The number of the component parts of the eccentric screw pump is kept as small as possible in this way, which decreases the production effort.

It is particularly favorable, however, when, for compression purposes, the support tube is inserted into a stationary support tube, which is fastened upstream of the front side of the stator housing, and its outer diameter is thereby inherently smaller than the smallest inner diameter of the section of the stationary support tube, which is available for insertion purposes.

The stationary support tube is then secured or screwed, respectively, to the front side of the stator housing. Those stator housings, which can also be used for the construction of non-settable eccentric screw pumps, can be used in this way in an unchanged manner for constructing the settable eccentric screw pumps. This also applies when these stator housings—in contrast to the mobile support tube—do not have a circular, but a polygonal clear cross section on the inner side.

The stationary support tube preferably has a first radial flange, with which one or several compression members engage, mostly in the form of traction means. If traction means are used, they are favorably embodied as threaded rods. Forces for the compression of the stator lining can be applied particularly easily with the help of such a radial flange, without requiring design changes to the substance of the stator housing.

For the most part, the mobile support tube then has a second radial flange, with which one or several of said compression members engage. The mobile support tube can participate particularly easily in this way in applying the forces, which are required for the compression of the stator lining.

Said threaded rods can be equipped, e.g., with nuts or rigid hexagon heads, which are tightened manually, if necessary, by means of an open-end wrench. In the alternative, they can also support fastening members, which are driven by means of a type of planet gear wheel by means of a sun-like gear wheel in the manner of a planetary gear. Ideally, the drive takes place in a motorized manner. Nuts on the threaded rods or the threaded rods themselves are rotated thereby.

At least at that point where particularly high forces are to be applied for the purpose of compression, the mobile support tube or the second radial flange, respectively, is preferably designed so that force, preferably even the largest portion of the force, is additionally also introduced into the stator lining via the front annular surface on the free front side of the projection. In some cases, it is favorable to even introduce essentially the full force.

Regardless of what has been claimed so far, protection is also claimed for a method for constricting the screw flight, which is formed by the elastomeric stator lining of an eccentric screw pump. The constriction according to the method takes place by means of compression of the stator lining, which is supported over its outer circumference in the radial direction by means of a stator housing, in the direction of the stator longitudinal axis. The compression force is thereby applied at a projection, which the stator lining forms, which projects on the front side out of the actual stator housing. The method according to the invention is characterized in that the compression force is applied at least partially, more than only insignificantly by means of a shear stress at the projection, which engages with one of its circumferential surfaces.

DETAILED DESCRIPTION

Overview

Figure 2:
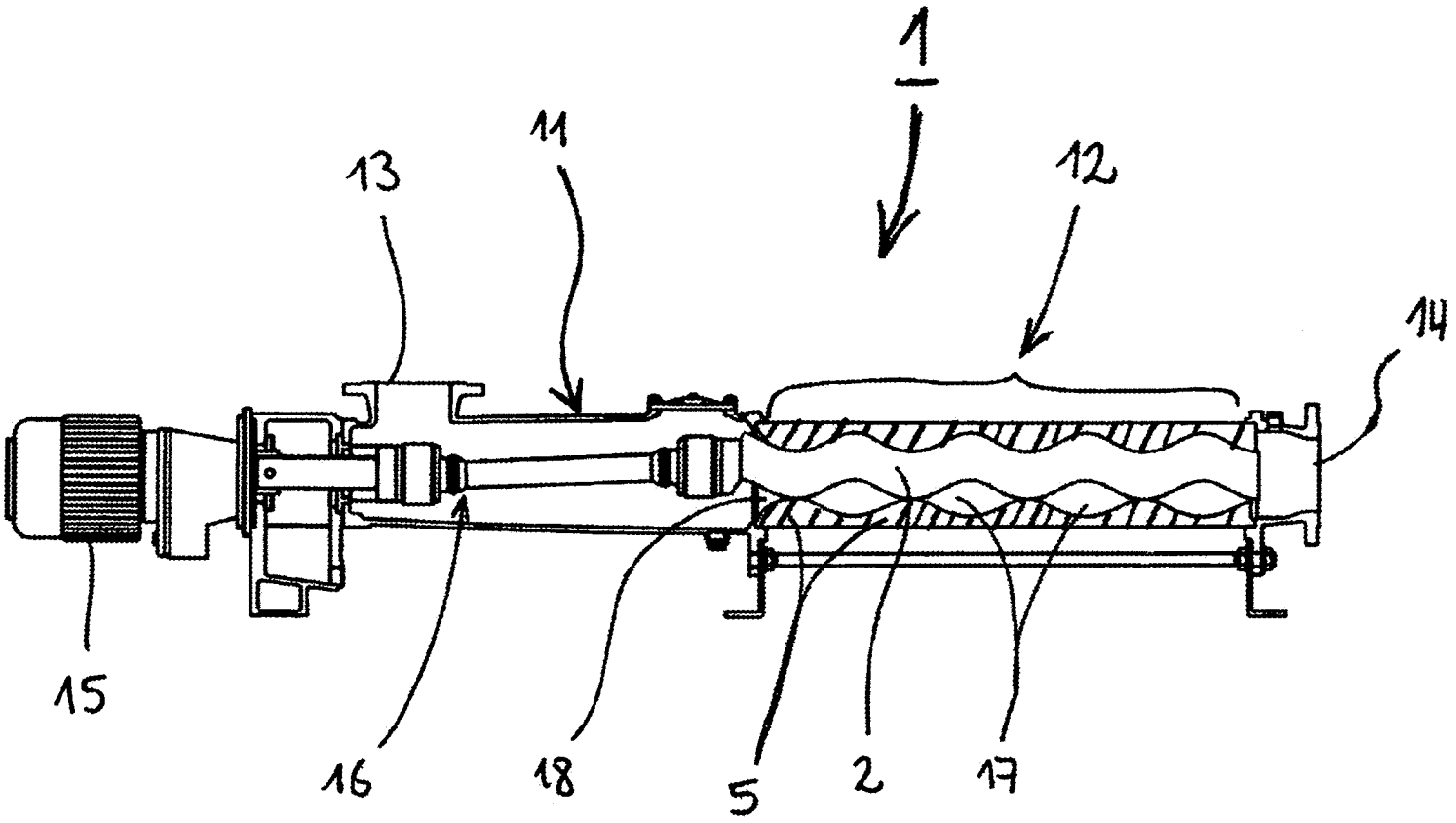
FIG. 2 shows an overview of an eccentric screw pump as a whole.

FIG. 2 shows the eccentric screw pump 1, which forms the basis for the invention, as a whole.

The main component parts of such an eccentric screw pump 1 are the suction housing 11 and the pump section 12, which is in flow connection therewith.

The inlet 13 for the medium to be conveyed is formed on the suction housing 11.

The conveyed medium is output via the outlet 14, which is arranged at the end of the pump section 12.

The block design is preferably selected, even if such a design is not mandatory under patent law. The pump motor 15 is then flanged to the suction housing 11. The pump motor 15 drives the rotor, which will be described in more detail in a moment, via the mostly cardanic powertrain 16.

The pump section is formed by the stator 3 comprising the rotor circulating therein.

An eccentric screw 2, which can be classified as round threaded screw, forms the rotor. Compared to a normal screw, the eccentric screw has a larger lead, a larger flight depth, and a smaller core diameter. The stator 3 is formed complementary to the rotor. It forms a "screw flight", which is equipped, however, with twice the lead length and an additional thread. Due to this arrangement, a row of conveying chambers 17 are created between the resting stator 3 and the rotor rotating eccentrically in the latter. The conveying chambers 17 move continuously and without change in shape from their inlet side on the suction housing 11 formed by the fantail 18, to their outlet side, i.e. to the outlet 14. The medium located in the conveying chambers 17 is thus pressurized and conveyed.

The movement speed of the conveying chambers 17 in the direction of the outlet side and thus the theoretical pump delivery volume can be controlled via the speed of the rotor.

In addition to the number of the stator windings, the impermeability of the line of contact between rotor and stator influences the absorption capacity and the conveying pressure of the pump, which can be attained.

The Design in Accordance with the Invention

Figure 3:
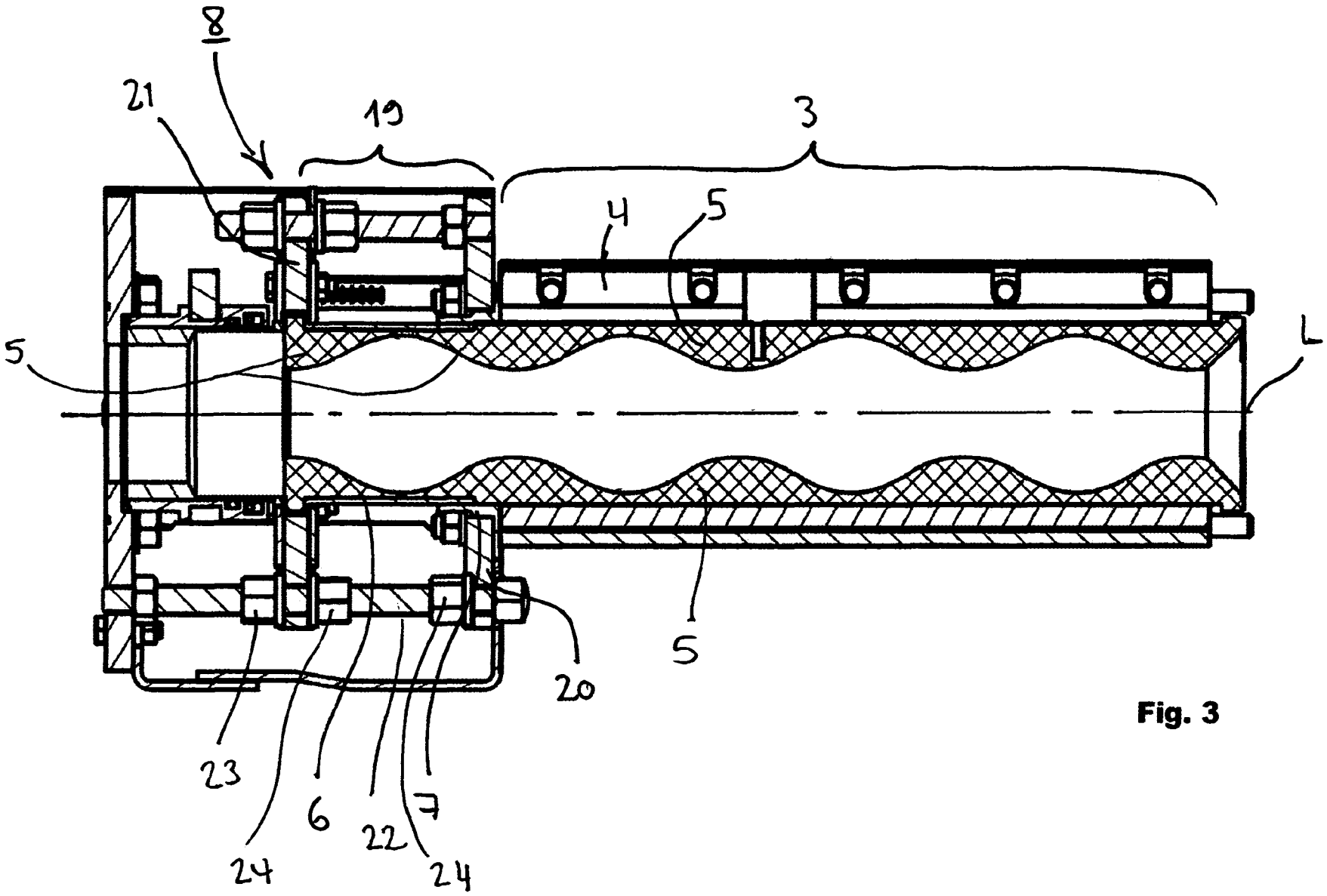
FIG. 3 shows the stator of an eccentric screw pump according to the invention.

FIG. 3 shows the pump section 12, which has already been mentioned on the basis of FIG. 2, but without illustrating the eccentric screw.

The stator 3 can be seen well in FIG. 3. It consists of the stator housing 4, which can optionally be divided here, in which the stator lining 5 is located. On its outer circumferential surface, the stator lining 5 does not have any or at least essentially no non-positive connection to the inner surface of the stator housing 4. The stator housing 4 thus does not prevent the compression of the stator lining 5, which will be described in more detail below.

The fact that the stator lining 5 projects from the stator housing 4 on the left side and forms a projection 19 there, can also be seen well on the basis of the figure. This projection 19 lies at least essentially radially within the mobile support tube 6. For the most part, the smaller portion lies within the stationary support tube 7.

A compression device 8 is connected to the support tubes 6 and 7. Said compression device comprises the first radial flange 20 of the stationary support tube 7 and the second radial flange 21 of the mobile support tube 6. The first radial flange 20 can be fastened to the stationary support tube 7 or directly to the stator housing 4. The second radial flange 21 is generally connected, preferably welded, to the mobile support tube 6. The distance of the two radial flanges 20 and 21 from one another can be adjusted. Ideally, a traction means 22 is provided for this purpose, preferably in form of a threaded rod. As can be seen here, the first radial flange 20 supports an internal thread for anchoring the threaded rod in this concrete case. The second radial flange 21 can have through holes, through which the respective threaded rod passes, in order to then be screw-connected to an actuating nut 23 on the other side.

It is noteworthy at this point that the radial flange 21—itself or with the help of a screw-connected annular member, respectively—is also able to apply compressive forces, which act from the left to the right here, to the free front annular surface of the stator lining 5 in the region of the projection 19. Such a design is optional.

Figure 4:
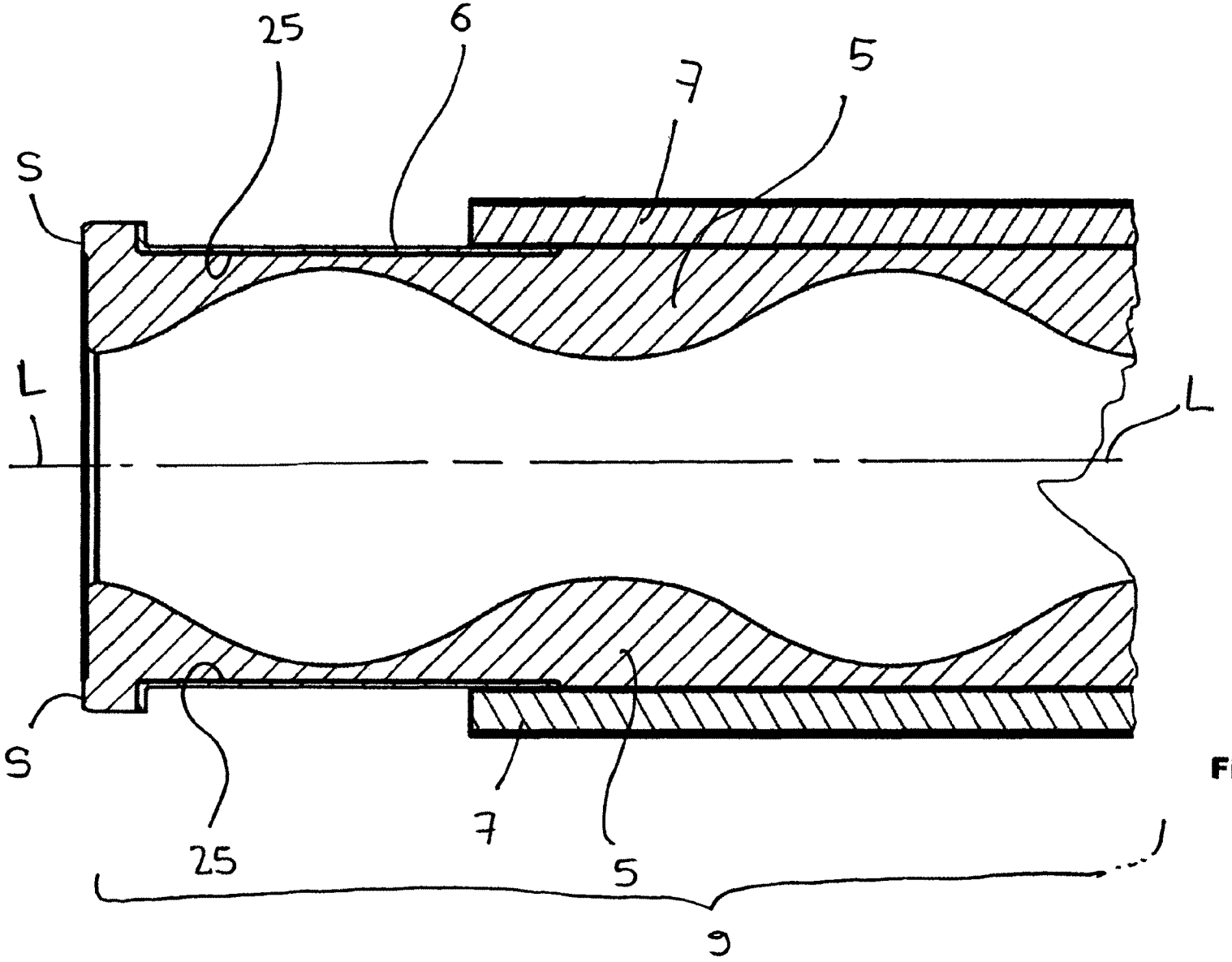
FIG. 4 shows a sectional enlargement from FIG. 3.

The positioning of the mobile support tube, which is special according to the invention, can be seen very well in FIGS. 3 and 4. This is so because on its outer circumferential surface, the stator lining 5 has a recess 25, which is designed in an annular cylindrical manner in many cases. It then has mostly a straight-cylindrical bottom and, at a right angle thereto, front side walls running radially outwards. The recess 25 is preferably long and flat. The amount, by which said bottom extends along the longitudinal axis L, is then preferably greater by at least the factor 7.5, or rather by at least the factor 10, than the amount, by which each front side wall of the recess extends radially to the outside.

The actual tube portion of the mobile support tube 6 is inserted into this recess 25—ideally so that there is no transition in terms of a perceivable, i.e. significant, diameter change, to the surrounding outer circumferential surface of the stator lining 5.

The mobile support tube 6 is ideally vulcanized into the stator lining 5 or is fastened thereto by means of adhesion or "welding" in the broader sense in such a way that—preferably over the entire bottom of the recess 25—a shear stress-proof connection, which goes beyond a pure frictional connection, is at hand between the inner surface of the circumference of the mobile support tube and the elastomer of the stator lining 5, which rests against said mobile support tube from the inside. It can be expedient to embody this shear stress-proof connection on a particularly large length, for instance on a length parallel to the longitudinal axis L of at least ½ or rather at least ⅔ of the outer diameter of the stator lining.

The stationary support tube 7, which can be seen in FIG. 4, is optionally present. It is advantageous in particular when a circular cross section is selected for reasons of a better uniformity during the compression for the support tube 6, while the stator housing 4 has a polygonal cross section. This difference is then able to catch the stationary support tube 7, which, in turn, mostly also has a circular cross section.

When turning back to FIG. 3, it is easy to understand, how the compression device 8 works.

Figure 1:
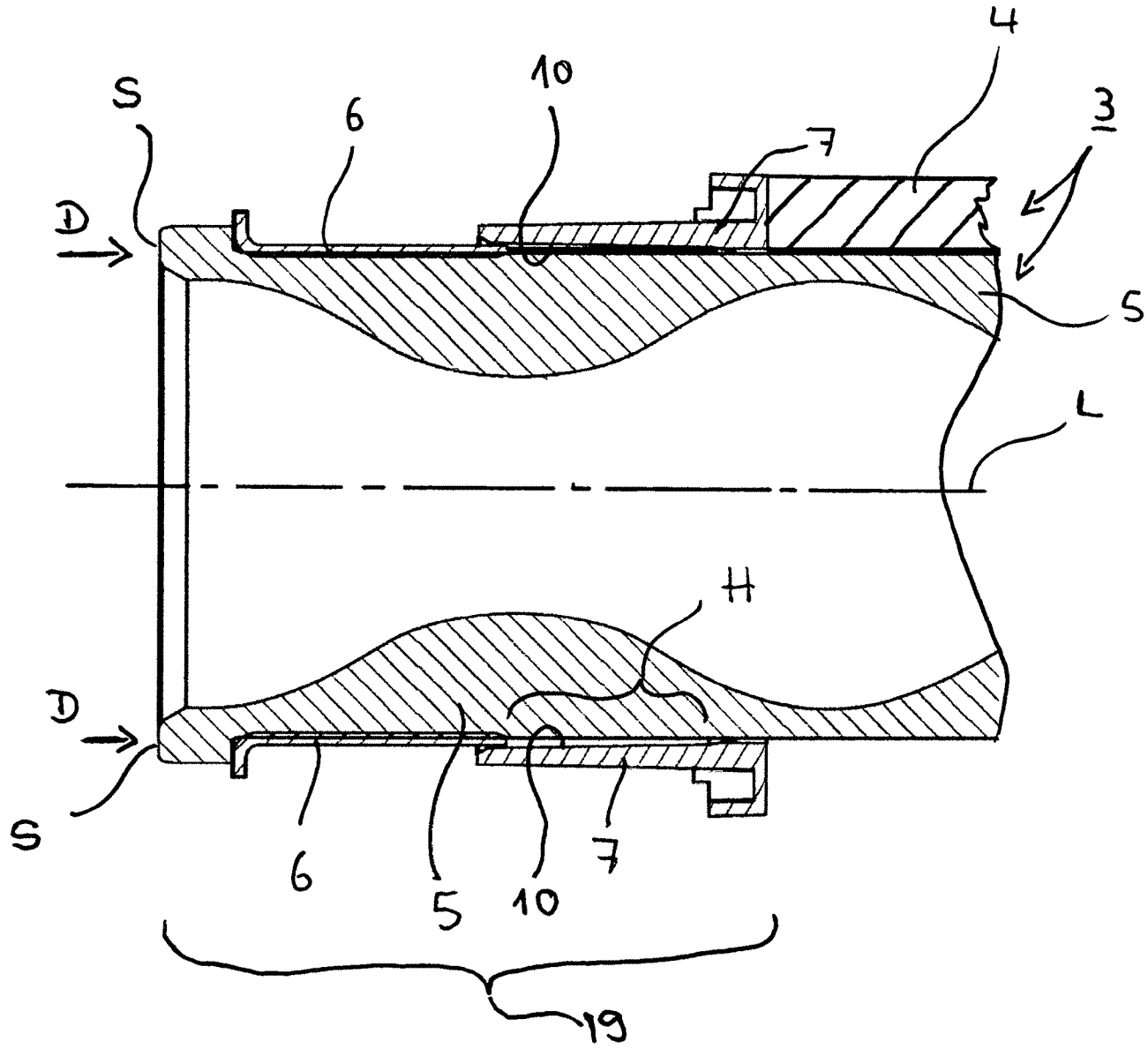
FIG. 1 shows a concept, which was considered earlier.

By tightening the actuating nut 23 and loosening the securing nut 24, which may have been done beforehand, the first radial flange 20 and the second radial flange 21 are moved towards one another. Due to the fact that the mobile support tube 6 is connected in a non-positive manner to the second radial flange 21, it is inserted into the stationary support tube 7 in the direction parallel to the longitudinal axis L. It is likewise noteworthy that the stator lining generally does not lie flat anywhere, but is completely supported everywhere in the radially outward direction. This also differs in this respect from the earlier solution shown in FIG. 1.

On its inner surface, the mobile support tube 6 thus transfers a shear stress onto the stator lining 5, which is located in its interior. Within the stator lining 5, said shear stress propagates into the region of the stator housing 4. However, the end of the stator lining 5, which faces away, is clamped firmly, can thus not move in the direction of the longitudinal axis L. Because of this, a transverse elongation occurs within the stator lining in the region of the stator housing 4. In the radially outward direction, this transverse elongation is prevented by means of the stator housing 4. Because of this, a significant transverse elongation occurs in the radially inward direction. Through this, the screw flight constricts. The shear stress-proof connection, which has already been described above, between the inner surface of the mobile support tube 6 and the portion of the stator lining 5 located therein, allows for a highly uniform force introduction into the stator lining 5.

At least one section of the screw flight thereby generally lies in the region underneath the mobile support tube 6, which has a maximum inside diameter and thus forms a region, in which the wall of the stator lining is only very thin. However, this thin point does not collaborate even during the compression because it is prevented from doing so by means of the connection to the inner surface of the mobile support tube 6.

As part of the compression, force can also be introduced via the front annular surface S of the stator lining 5 in the region of the free end of the projection 19. This is often even the majority of the force, which is introduced for the purpose of compression.

It is also important to note that the effect of the constriction of the screw flight can also be reversed. This is so because tractive forces can also be transferred to the stator lining 5 with the help of the mobile support tube 6 via the compression device 8 due to the corresponding design thereof. The described shear stress-proof connection between the inner surface of the mobile support tube 6 and the portion of the stator lining 5 located therein thereby has a particularly advantageous effect. This is so because a shear stress, which leads to a high tensile stress in the further course of the stator lining 5, can be introduced very well therewith.

The invention claimed is:

1. An eccentric screw pump comprising:

a rotor forming a conveyor screw;

a stator comprising a single- or multi-part stator housing, in which a stator lining made of an elastomeric material is located, said stator housing and stator lining forming a screw flight in which the rotor circulates during a conveying operation;

wherein at least on one side in the direction along the pump longitudinal axis, the stator lining forms a projection, which projects from the stator housing so that a free force introduction surface is formed, via which a force can be applied, which compresses the stator lining all the way into the stator housing, so that a radially inward displacement of the stator lining is created there, which leads to a constriction of the screw flight;

wherein the projection is encompassed by a mobile support tube, which for the purpose of compression can be displaced in the direction along the longitudinal axis of the stator housing relative to the stator housing; and wherein the stator lining has a recess in the region of the projection, into which recess the mobile support tube is vulcanized over the entire base of the recess or is attached thereto by bonding or welding, such that an outer circumference of the mobile support tube is flush with an outer circumference of the stator lining.

2. The eccentric screw pump according to claim 1, wherein the mobile support tube is connected by means of a substance-to-substance bond to the stator lining on its inner jacket surface, in such a way that it can transfer compression force on the stator lining via said connection by generating shear stresses.

3. The eccentric screw pump according to claim 2, wherein the mobile support tube is inserted into the stator housing itself for compression purposes, and that its outer diameter is smaller than the smallest inner diameter of the section of the stator housing, which is available for insertion purposes.

4. The eccentric screw pump according to claim 2, wherein, for compression purposes, the mobile support tube is inserted into a stationary support tube, which is fastened upstream of the front side of the stator housing, and that its outer diameter is smaller than the smallest inner diameter of the section of the stationary support tube, which is available for insertion purposes.

5. The eccentric screw pump according to claim 2, wherein the mobile support tube has a second radial flange, with which one or more compression members engage, said compression members being threaded rods.

6. The eccentric screw pump according to claim 1, wherein the mobile support tube is inserted into the stator housing itself for compression purposes, and that its outer diameter is smaller than the smallest inner diameter of the section of the stator housing, which is available for insertion purposes.

7. The eccentric screw pump according to claim 1, wherein, for compression purposes, the mobile support tube is inserted into a stationary support tube, which is fastened upstream of the front side of the stator housing, and that its outer diameter is smaller than the smallest inner diameter of the section of the stationary support tube, which is available for insertion purposes, wherein the stationary support tube has at its upstream end an inner perimeter into which the mobile support tube and the stator lining can slide.

8. The eccentric screw pump according to claim 7, wherein the stationary support tube has a first radial flange, with which one or more threaded rods engage.

9. The eccentric screw pump according to claim 1, wherein the mobile support tube has a second radial flange, with which one or more compression members engage, said compression members being threaded rods.

10. The eccentric screw pump according to claim 9, wherein the second radial flange is designed so that, during the compression, it also introduces a force into the projection on the free front side thereof via a front annular surface of the stator lining.

* * * * *